US007516505B2

(12) United States Patent
Sawa

(10) Patent No.: US 7,516,505 B2
(45) Date of Patent: Apr. 14, 2009

(54) DRY CLEANING METHOD AND APPARATUS THEREFOR

(76) Inventor: Kohei Sawa, c/o Clean SAWA Kabushiki Kaisha, 1-33, Uzu 1-chome, Wakayama-shi, Wakayama, 641-0043 (JP)

( * ) Notice: Subject to any disclaimer, the term of this patent is extended or adjusted under 35 U.S.C. 154(b) by 598 days.

(21) Appl. No.: 10/967,775

(22) Filed: Oct. 18, 2004

(65) Prior Publication Data

US 2005/0091758 A1 May 5, 2005

(30) Foreign Application Priority Data

Oct. 29, 2003 (JP) ..... 2003-368726

(51) Int. Cl.
*D06F 33/02* (2006.01)

(52) U.S. Cl. ..... 8/158; 8/159; 68/18 R; 68/18 C

(58) Field of Classification Search ..... 68/12.02, 68/12.12, 18 R, 18 C
See application file for complete search history.

(56) References Cited

U.S. PATENT DOCUMENTS 4,780,218 A * 10/1988 Kohler ..... 210/774
5,203,998 A * 4/1993 Benian ..... 210/493.5
5,334,291 A * 8/1994 Gavlin et al. ..... 202/234
6,868,700 B2 * 3/2005 Sawa ..... 68/12.08

FOREIGN PATENT DOCUMENTS

| | | | |
|---|---|---|---|
| FR | 2 594 149 | * | 8/1987 |
| JP | S57-160651 | | 10/1982 |
| JP | 5-383394 | * | 2/1993 |
| JP | 11-326201 | * | 11/1999 |

* cited by examiner

*Primary Examiner*—Frankie L Stinson
(74) *Attorney, Agent, or Firm*—Butzzel Long

(57) ABSTRACT

The object is to determine a suitable stop timing of dry cleaning operation in a dry cleaning method without an oil-soluble surface-active agent. Contamination level of a pure solvent supplied from a supply tank to an inner drum of a process tank by a supply-side pump is detected by a supply-side RGB sensor. Contamination level of a used solvent collected from the process tank to a distilling unit by a collect-side pump is detected by a collect-side RGB sensor. When the deference of the contamination levels becomes to zero, a control unit stops supplying the pure solvent from the supply tank to the process tank, collecting the used solvent from the process tank to the distilling unit.

8 Claims, 2 Drawing Sheets

DRY CLEANING METHOD AND APPARATUS THEREFOR

BACKGROUND OF THE INVENTION

1. Field of the Invention

This invention relates to a dry cleaning method and a dry cleaning apparatus for the method using an organic solvent, such as tetrachloroethylene, for a cleaning fluid.

2. Description of the Related Art

In a general dry cleaning using an organic solvent, such as tetrachloroethylene, for a cleaning fluid, pre-cleaning and main cleaning are acted in each predetermined time by using a solvent mixed with a cleaning agent including an oil-soluble surface-active agent in batch process or to be circulated through a filter.

The solvent used in the pre-cleaning or the main cleaning is recycled by purification through distillation and condensation processes because it is not allowed to dispose the solvent to sewerage and price of the solvent is high.

If the solvent is not distilled completely, remained dirt in the solvent not removed by distillation may stick again to cleaning objects as reverse contamination when the solvent is reused. For preventing the reverse contamination, it is already proposed to control volume of distillation correspondingly to absolute contamination level of the used solvent detected by a sensor. It is shown in Japan Utility Model Application Laid-open S57-160651.

Objects to be Solved

The oil-soluble surface-active agent used together with the solvent for pre-cleaning and main cleaning has lipophilic group and hydrophilic group. The surface-active agent adheres to aqueous dirt on the cleaning objects and penetrates into the cleaning objects so as to generate reversed micellar disposing lipophilic group outwardly by enclosing the dirt. Thereby, the aqueous dirt is removed from the cleaning objects, so that the reversed micellar exists as dirt component in the used solvent.

When the used solvent is distilled, solvent having low boiling point is vaporized and the reversed micellar having high boiling point stays as residue. The residue may be finally disposed of as industrial waste.

It shall be avoided for protecting environment to generate the industrial waste in process of distilling the used solvent. Additionally, it is confirmed by the applicant that aqueous dirt of the cleaning objects can be washed off by using moisture in the air. Dry cleaning without surface-active agent becomes to be realized.

In the general dry cleaning, pre-cleaning and main cleaning are acted by using the used solvent mixed with the cleaning agent in batch process or to be circulated through a filter. In the dry cleaning without surface-active agent, the used solvent without cleaning agent is collected continuously from the process tank, and whole volume of the solvent is flown back to a base tank by purification through distillation and condensation processes. On the other hand, The pure solvent is supplied continuously from the base tank to the process tank for replenishment. Thus, cleaning and rinsing can be acted continuously without a filter.

According to the dry cleaning without surface-active agent, generating industrial waste by the residue of the reversed micellar can be eliminated. The purified solvent is replenished continuously to the process tank, so that the required net volume of the solvent for total can be reduced in comparison with usual dry cleaning which washes the cleaning objects without intermediate replenishment of the solvent by supplying previously larger volume of the pure solvent. Therefore, the dry cleaning according to this invention has a big advantage for environmental issue.

According to the dry cleaning without surface-active agent, it is no chance that the same solvent in the process tank is used continuously for long time. Thereby, monitoring absolute contamination level of the used solvent for adjusting vaporized volume of the used solvent is not required.

According to the usual dry cleaning, the whole solvent used for cleaning is replaced periodically. In the dry cleaning without surface-active agent according to this invention, pre-cleaning and main cleaning are acted continuously by circulating the same solvent which is purified through distillation and condensation processes. Therefore, time for pre-cleaning or main cleaning determined for the usual dry cleaning cannot be applied for the dry cleaning according to this invention. In this dry cleaning, it is very important how suitable stop timing of the dry cleaning process is determined.

To have solutions for above issues, one object of this invention is to provide a dry cleaning method for dry cleaning without surface-active agent by acting simultaneously cleaning and purification of the solvent by distillation, in which a suitable stop timing of the dry cleaning process can be known easily and a dry cleaning apparatus suitable to be used for performing the dry cleaning method.

SUMMARY OF THE INVENTION

The dry cleaning method according to the invention has the steps of supplying a solvent for dry cleaning into a process tank for cleaning objects, collecting the solvent from the process tank as a collected solvent, and recycling substantially whole volume the collected solvent as the solvent to be supplied to the process tank after removing dirt component in the collected solvent by distillation-and-condensation process. The dry cleaning method is specified by the steps of storing the solvent to be supplied to the process tank in a supply tank, collecting the solvent continuously from the process tank as a collected solvent, supplying the collected solvent to distillation-and-condensation process, replenishing the solvent in the process tank by supplying continuously the solvent from the supply tank to the process tank, monitoring contamination level of the solvent being supplied continuously from the supply tank to the process tank and contamination level of the collected solvent being collected continuously from the process tank and supplied to the distillation-and-condensation process, and ceasing dry cleaning operation for the cleaning objects in the process tank when the contamination level of the collected solvent being collected from the process tank and supplied to the distillation-and-condensation process is decreased until a difference of the monitored contamination levels reaches to a predetermined value after starting dry cleaning operation for the cleaning objects.

The dry cleaning method according to this invention is further specified in the dry cleaning method mentioned above by that the more the difference of the monitored contamination levels is large, the more a rotation speed of the process tank is decreased, and the more the difference of the monitored contamination levels is small, the more the rotation speed is increased.

The dry cleaning method according to this invention is further specified in the dry cleaning method mentioned above by that a color sensor capable of detecting a chromaticity of a specific color component in the solvent is used for monitoring the contamination levels so as to monitor the chromaticity of a specific color of an oil stained component in the solvent.

The dry cleaning method according to this invention is further specified in the dry cleaning method mentioned above by that a color sensor capable of detecting a chromaticity of a specific color component in the solvent is used for monitoring the contamination level of the collected solvent being collected from the process tank and supplied to the distillation-and-condensation process. And the dry-cleaning operation for the cleaning objects in the process tank is ceased forcibly when the chromaticity of a color component other than that of a specific color of an oil stained component in the collected solvent, which is collected from the process tank and supplied to the distillation-and-condensation process, detected by the color sensor increase over a reference value after starting dry cleaning operation for the cleaning objects whether or not the contamination level of the collected solvent being collected from the process tank and supplied to the distillation-and-condensation process is decreased until the difference of the monitored contamination levels reaches to the predetermined value.

A dry cleaning apparatus for the method according to the invention is performed by supplying a solvent for dry cleaning into a process tank for cleaning objects, collecting the solvent from-the process tank as a collected solvent, and after removing dirt component in the collected solvent by a distilling device and a condensing device, recycling substantially whole volume of the collected solvent as the solvent to be supplied to the process tank. The dry cleaning apparatus for the method is specified by including a supply tank storing the solvent to be supplied to the process tank, a solvent supplying device for supplying the solvent continuously from the supply tank to the process tank, a solvent collecting device for collecting the solvent continuously from the process tank, a rotation driver for rotating the process tank, a supply-side contamination sensor for detecting contamination level of the solvent supplied continuously from the supply tank to the process tank, a collect-side contamination sensor for detecting contamination level of the collected solvent being collected continuously from the process tank and supplied to the distilling device, and a controller for controlling the rotation driver, the solvent supplying device and the solvent collecting device. The controller stops rotation of the process tank by the rotation driver, supply of the solvent from the supply tank to the process tank by the solvent supplying device, and collection of the solvent from the process tank to the distilling device by the solvent collecting device when the contamination level detected by the collect-side contamination sensor is decreased until a difference of the detected contamination levels reaches to a predetermined value while the process tank is rotated by the rotation driver.

The dry cleaning apparatus according to the invention is further specified in the dry cleaning apparatus mentioned above by that the controller controls the rotation of the process tank by the rotation driver so as to make a rotation speed of the process tank at a larger difference of contamination levels detected respectively by the contamination sensors relatively slower than the rotation speed of the process tank at a smaller difference of the contamination levels.

The dry cleaning apparatus according to the invention is further specified in the dry cleaning apparatus mentioned above by that color sensors capable of detecting a chromaticity of a specific color component in the solvent are used for each contamination sensor, and the each contamination sensor detects the chromaticity of a specific color of an oil stained component in the solvent as the contamination level of the solvent.

The dry cleaning apparatus according to the invention is further specified in the dry cleaning apparatus mentioned above by that a color sensor capable of detecting a chromaticity of a specific color component in the solvent is used as the collect-side contamination sensor, and detects a chromaticity of a color component other than that of the specific color of the oil stained component in the solvent as the contamination level of the solvent, and the controller forcibly stops rotation of the process tank by the rotation driver, supply of the solvent from the supply tank to the process tank by the solvent supplying device, and collection of the solvent from the process tank to the distilling device by the solvent collecting device when the contamination level detected by the collect-side contamination sensor is increased over a reference value while the process tank is rotated by the rotation driver whether or not the contamination level detected by the collect-side contamination sensor is decreased until the difference of the detected contamination levels reaches to the predetermined value.

EFFECTS OF THE INVENTION

According to the dry cleaning method, at an early step of the dry cleaning operation for cleaning objects in the process tank, dirt dissolved into the solvent in the process tank from the cleaning objects exists relatively much. Thereby, the contamination level of the used solvent (the collected solvent) which is collected continuously from the process tank and supplied to the distillation-and-condensation process, is higher than that of the pure solvent supplied continuously from the supply tank to the process tank.

In accordance with progression of the dry cleaning operation, dirt remained on the cleaning objects is decreased and dirt dissolved in the solvent in the process tank is decreased. Thereby, the contamination level of the used solvent, which is collected continuously from the process tank and supplied to the distillation-and-condensation process, goes down and nears to the contamination level of the solvent which is supplied continuously to the process tank from the supply tank after purification of the solvent in which dirt is removed by the distillation process. Thus, the dry cleaning operation in the process tank shifts practically from washing to rinsing.

When dirt of the cleaning objects is removed to reach certain level, dirt that is removed from the cleaning objects and dissolved in the solvent in the process tank is decreased to reach certain level. Thereby, the contamination level of the used solvent, which is collected continuously from the process tank and supplied to the distillation-and-condensation process, goes down so as to reduce a difference of the contamination level thereof and the contamination level of the pure solvent, which is supplied continuously to the process tank from the supply tank, within a predetermined value. Then, the dry cleaning operation of the cleaning objects in the process tank is ceased and continuous supply of pure solvent from the supply tank to the process tank and continuous collect of the used solvent from the process tank to the distillation process are ceased.

Thus, instead of determining the stop timing of dry cleaning process by time as usual, determining the suitable stop timing by detecting the completion level of cleaning securely by comparing contamination levels between the used solvent and the pure solvent supplied to the process tank, energy loss by unexpected distillation-and-condensation process of the solvent and unexpected deterioration of cloths of cleaning objects caused by contacting with the solvent in the process tank for long time over required time can be prevented.

According to the dry cleaning method, when much dirt is remained on the cleaning objects and the amount of dirt in the solvent in the process tank is relatively large, the difference between the contamination levels of the pure solvent supplied continuously from the supply tank to the process tank and the used solvent collected continuously from the process tank and supplied to the distillation-and-condensation process becomes relatively large and the rotation speed of the process tank is slowed.

Thereby, centrifugal force acting on the cleaning objects in the process tank is decreased so that the cleaning objects are not pushed so much on an inner wall of the process tank. The cleaning objects can be rolled easier in the process tank and cleaning process can be progressed by effects of tapping the cleaning objects on the inner wall of the process tank.

When dirt remained on the cleaning objects is decreased and the amount of dirt in the solvent in the process tank is relatively small, the difference between the contamination levels of the pure solvent supplied continuously from the supply tank to the process tank and the used solvent collected continuously from the process tank and supplied to the distillation-and-condensation process becomes relatively small and the rotation speed of the process tank is increased.

Thereby, the centrifugal force acting on the cleaning objects in the process tank is increased so that the cleaning objects are pushed on an inner wall of the process tank. The cleaning objects cannot be rolled easier in the process tank and cleaning process is slowed by reduced effects of tapping the cleaning objects on the inner wall of the process tank. Oppositely, cloths of the cleaning objects and touch thereof are protected.

Thus, protection of unexpected deterioration of cloths of cleaning objects by detecting the completion level of cleaning securely and determining the suitable stop timing can be more enhanced by using effects of suitably tapping the cleaning objects on the inner wall of the process tank.

According to the dry cleaning method, by monitoring the chromaticity of the specific color of the oil stained component in the solvents those are the pure solvent supplied continuously from the supply tank to the process tank and the used solvent collected continuously from the process tank and supplied to distillation-and-condensation process during the dry cleaning operation, the contamination levels of the pure solvent and the used solvent can be monitored in reference with an amount (a chromaticity of a color) of an oil stained component in the solvent.

When the amount (the chromaticity of the color) of the oil stained component in the used solvent, which is collected continuously from the process tank and supplied to the distillation-and-condensation process is decreased until the difference between the amount (the chromaticity of the color) of the oil stained component thereof and the amount (the chromaticity of the color) of the oil stained component in the pure solvent supplied from the supply tank to the process tank is decreased within the predetermined value, the dry cleaning operation for the cleaning objects in the process tank, and continuous supply of pure solvent from the supply tank to the process tank and continuous collect of the used solvent from the process tank to the distillation-and-condensation process are ceased.

Thus, the completion level of cleaning is detected by comparing the contamination levels of the used solvent and the pure solvent supplied to the process tank based on the oil stained component of the cleaning objects. Thereby, the suitable stop timing can be determined.

According to the dry cleaning method, even if dirt remained on the cleaning objects is decreased and the amount of dirt dissolved in the solvent in the process tank is reduced to a certain level, the contamination level of the used solvent collected continuously from the process tank and supplied to the distillation-and-condensation process is hardly reduced until the difference of the contamination level of the used solvent and the contamination level of the pure solvent continuously supplied from the supply tank to the process tank decreases under the predetermined value, because its color component by discoloration of the cleaning objects is dissolved into the solvent.

When the chromaticity of the color component other than that of the specific color of the oil stained component in the used solvent collected from the process tank and supplied to the distillation-and-condensation process increase over the reference value after starting dry cleaning operation for the cleaning objects, the dry cleaning process for the cleaning objects in the process tank is ceased forcibly. Thereby, continuous supplying the pure solvent from the supply tanks to the process tank and continuous collecting the used solvent from the process tank for the distillation process are ceased, and dissolving the color component into the solvent in the process tank by discoloration of the cleaning objects is stopped.

By preventing that the increase of contamination level of the used solvent by the discoloration of the cleaning objects is identified as condition that dirt of cleaning objects is not completely removed, cloths of cleaning objects that is dyed not strongly is prevented from discoloring.

In the dry cleaning apparatus according to this invention, at an early step of the dry cleaning operation for cleaning objects in the process tank, dirt of the cleaning objects dissolved into the solvent exists relatively much. Therefore, the contamination level of the used solvent, which is collected continuously from the process tank and supplied to the distillation-and-condensation process, detected by the collect-side contamination sensor is higher than that of the pure solvent supplied continuously from the supply tank to the process tank by the solvent supplying device, detected by the supply-side contamination sensor.

In accordance with progression of the dry cleaning operation, dirt remained on the cleaning objects is decreased and dirt dissolved in the solvent in the process tank is decreased. Thereby, the contamination level of the used solvent detected by the collect-side contamination sensor goes down and nears to the contamination level of the pure solvent detected by the supply-side contamination sensor. Thus, the dry cleaning operation in the process tank shifts practically from washing to rinsing.

When dirt of the cleaning objects is removed to reach a certain level, dirt that is removed from the cleaning objects and dissolved in the solvent in the process tank is decreased to reach a certain level. Thereby, the contamination level of the used solvent detected by the collect-side contamination sensor goes down so as to reduce the difference between the contamination level of the used solvent and the contamination level of the pure solvent detected by the supply-side contamination sensor within a predetermined value. Then, rotating the process tank by the rotation driver, supplying the solvent from the supply tank to the process tank by the solvent supplying device and collecting the used solvent from the process tank to the distillation-and-condensation process by the solvent collecting device are ceased. Thus, the dry cleaning operation of the cleaning objects in the process tank is ceased.

Thus, instead of determining the stop timing of dry cleaning operation by time as usual, by detecting the completion level of cleaning securely by comparing contamination level of the used solvent detected by the collect-side contamination sensor and the contamination level of the pure solvent detected by the supply-side contamination sensor, the suitable stop timing is determined by the controller. Energy loss by the distilling device and the condensing device and unexpected deterioration of cloths of cleaning objects caused by contacting with the solvent in the process tank for long time over required time can be prevented.

According to the dry cleaning apparatus, by detecting a chromaticity of a specific color of an oil stained component in the solvents, those are the pure solvent supplied continuously from the supply tank to the process tank by the solvent supplying device and the used solvent collected continuously from the process tank by the solvent collecting device and supplied to the distilling device, with the collect-side and supply-side contamination sensors, the contamination levels of the pure-solvent and the used solvent can be respectively detected in reference with an amount (a chromaticity of a color) of an oil stained component in the solvents.

When the amount (the chromaticity of the color) of the oil stained component in the used solvent detected by the collect-side contamination sensor is decreased until the difference between the amount (the chromaticity of the color) of the oil stained component in the pure solvent detected by the supply-side contamination sensor is decreased within the predetermined value, rotating the process tank by the rotation driver, supply of the solvent from the supply tank to the process tank by solvent supplying device and collect of the used solvent from the process tank to the distilling device by the solvent collecting device are ceased by the controller. Thus, the dry cleaning operation for the cleaning objects in the process tank is completed.

Thus, the completion level of cleaning by the controller is detected by comparing the contamination level of the used solvent detected by the collect-side contamination sensor and the contamination level of the pure solvent detected by the supply-side contamination sensor based on the oil stained component of the cleaning objects. Thereby, the more suitable stop timing of dry cleaning operation can be determined.

In accordance with progression of the dry cleaning process, even if dirt remained on the cleaning objects is decreased and amount of dirt dissolved in the solvent in the process tank is reduced to a certain level, the contamination level of the used solvent detected by the collect-side contamination sensor is hardly reduced until a difference of the contamination level of the used solvent and the contamination level of the pure solvent decreases under a predetermined value, because its color component by discoloration of the cleaning objects is dissolved into the solvent.

When the chromaticity of the color component other than that of the specific color of the oil stained component in the used solvent increase over a reference value while the process tank is rotating by the rotation driver, rotating the process tank by the rotation driver, supply of the solvent from the supply tank to the process tank by solvent supplying device, and collect of the used solvent from the process tank to the distilling device by the solvent collecting device are ceased by the controller. Thus, the dry cleaning operation for the cleaning objects in the process tank is completed, and dissolving the color component into the solvent in the process tank by discoloration of the cleaning objects is stopped.

By preventing that the increase of contamination level of the used solvent by the discoloration of the cleaning objects, which is detected by the collect-side contamination sensor, is identified by the controller as a condition that dirt of cleaning objects is not completely removed, cloths of cleaning objects that is dyed not strongly is prevented from discoloring.

According to the dry cleaning apparatus, when much dirt is remained on the cleaning objects and the amount of dirt in the solvent in the process tank is relatively large, the difference between the contamination level of the pure solvent detected by the supply-side contamination sensor and the contamination level of the used solvent detected by the collect-side contamination sensor becomes relatively large and the rotation speed of the process tank is slowed.

Thereby, centrifugal force acting on the cleaning objects in the process tank is decreased so that the cleaning objects are not pushed so much on an inner wall of the process tank. The cleaning objects can be rolled easier in the process tank and cleaning process can be progressed by effects of tapping the cleaning objects on the inner wall of the process tank.

When dirt remained on the cleaning objects is decreased and the amount of dirt in the solvent in the process tank is relatively small, the difference between the contamination level of the pure solvent detected by the supply-side contamination sensor and the contamination level of the used solvent detected by the collect-side contamination sensor becomes relatively small and the rotation speed of the process tank is increased.

Thereby, the centrifugal force acting on the cleaning objects in the process tank is increased so that the cleaning objects are pushed on an inner wall of the process tank. The cleaning objects cannot be rolled easier in the process tank and cleaning process is slowed by reduced effects of tapping the cleaning objects on the inner wall of the process tank. Oppositely, cloths of the cleaning objects and touch thereof are protected.

Thus, protection of unexpected deterioration of cloths of cleaning objects by detecting the completion level of cleaning securely and determining the suitable stop timing by the controller can be more enhanced by using effects of suitably tapping the cleaning objects on the inner wall of the process tank, the effects generated by controlled rotation of the process tank by the controller.

The above and other objects and features of this invention will become more apparent from the following description taken in conjunction with the accompanying drawings.

DESCRIPTION OF THE PREFERRED EMBODIMENT

Dry cleaning methods and a dry cleaning apparatus for the dry cleaning methods according to the present invention will now be described with reference to drawings.

Figure 1:
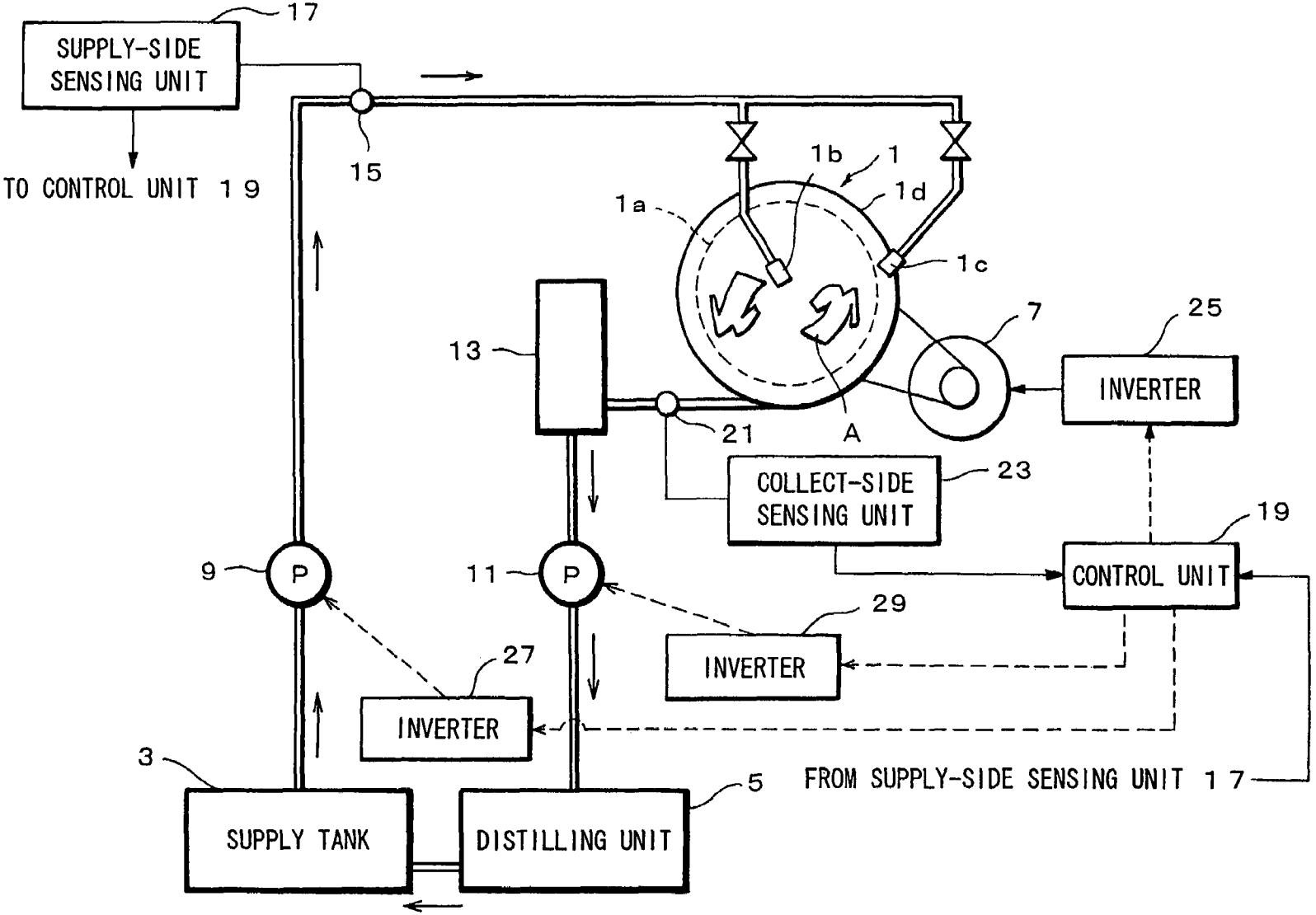
FIG. 1 is a partial constitutional block diagram, showing one embodiment of a dry cleaning apparatus according to this invention.

FIG. 1 is showing a block diagram of one embodiment of the dry cleaning apparatus according to this invention. Cleaning objects is washed by dry cleaning in a process tank 1 in FIG. 1.

The dry cleaning apparatus of this embodiment includes a supply tank 3 for storing a solvent (for example, an organic solvent such as tetrachloroethylene or the like) for a cleaning liquid supplied to the process tank 1, and a distilling unit 5 being supplied a used solvent (a collected solvent) collected from the process tank 1.

In the distilling unit 5, dirt in the used solvent collected from the process tank 1 is separated and removed by heating and vaporizing the used solvent, and the vaporized solvent to be removed dirt is liquefied so as to be recycled to a pure solvent. The distilling unit 5 in the embodiment corresponds to the distilling device and the condensing device in the present invention.

The distilling unit 5 of the embodiment can be structures by a distillation apparatus described in Japan Patent Application No. 2002-314435, filed by the same applicant as this invention. The distilling device and condensing device in the present invention can be formed separately with an evaporator and a condenser.

In the dry cleaning apparatus, the solvent vaporized and liquefied by the distilling unit 5 can be returned the supply tank 3 below the distilling unit 5 by a self-weight, or can be transferred by driving power such as a pump.

Dry cleaning operation of a cleaning objects A is proceeded in an inner drum 1*a* of the process tank 1 rotated by a drum motor 7, as the rotation driver in this invention.

Pure (new) solvent is supplied from the supply tank 3 to the process tank 1 by a supply-side pump 9 as the solvent supplying device. In the dry-cleaning operation of the cleaning objects A, the supplied pure solvent is sprayed from a nozzle 1*b* into the inner drum 1*a*. In process of washing an outer surface of the inner drum 1*a* after dry cleaning operation, the solvent is sprayed from a nozzle 1*c* to a space between the inner drum 1*a* and an outer drum 1*d* of the process tank 1.

The used solvent is collected from the process tank 1 to the distilling unit 5 by a collect-side pump 11 as the solvent collecting device. Buttons and lint in the used solvent collected from the process tank 1 are removed a button trap 13 at middle way to the distilling unit 5.

The pure (new) solvent of the supply tank 3 is detected about chromaticities of three primary colors, R (Red), G (Green) B (Blue) by a supply-side RGB color sensor 15 as the supply-side contamination sensor in the middle way of supplying to the process tank 1. Digital values of respective colors are outputted from a supply-side sensing unit 17 to a control unit 19 as the controller.

The used solvent collected from the process tank 1 is detected about chromaticities of three primary colors, R (Red), G (Green), B (Blue) by a collect-side RGB color sensor 21 as the collect-side contamination sensor in the middle way to the button trap 13. Digital values of respective colors are outputted from a collect-side sensing unit 23 to a control unit 19 as the controller.

A programmable sequencer performs the control unit 19 in the embodiment. The control unit 19 controls rotation of the inner drum 1*a* of the process tank 1 by the drum motor 7 by means of an inverter 25, accordingly to the digital values of RGB three primary colors of the pure (new) solvent of the supply tank 3 and the used solvent collected from the process tank 1 inputted from the supply-side sensing unit 17 and the collect-side sensing unit 23 to the control unit 19. The control unit 19 also controls volume of supplying pure solvent from the supply tank 3 to the process tank 1 by the supply-side pump 9 and volume of collecting the used solvent from the process tank 1 to the distilling unit 5 by the collect-side pump 11 by means of inverters 27, 29.

Figure 2:
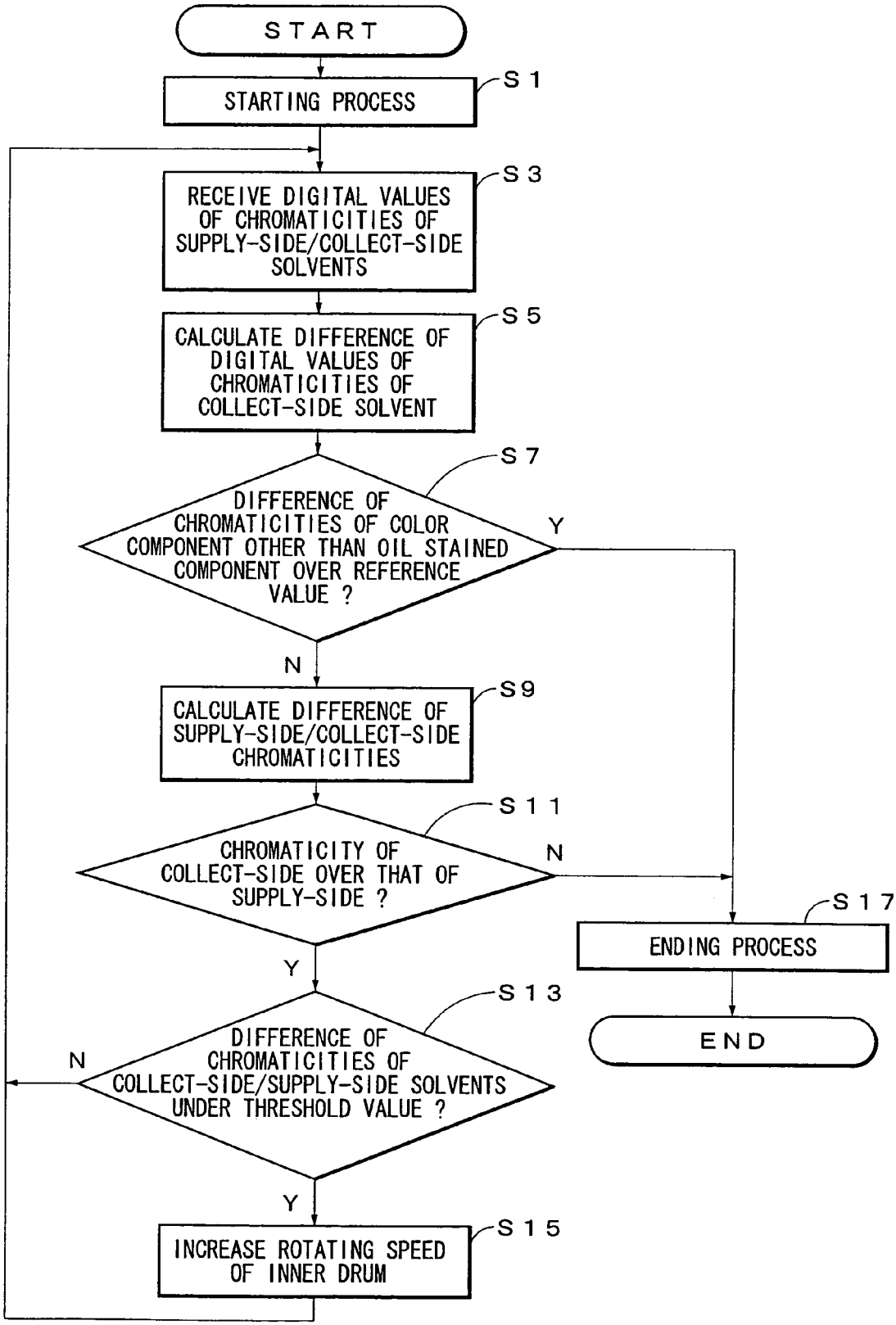
FIG. 2 is a flow chart, showing outline of processes executed in accordance with a control program stored in an inner memory by a control unit shown in FIG. 1.

The control unit 19 controls the drum motor 7, the supply-side pump 9 and the collect-side pump 11 by means of the inverters 25, 27, 29 accordingly to a control program stored in a memory of the control unit 19. Process of control by the control unit 19 is shown in outline by a flow chart in FIG. 2.

When the control unit 19 is started by turning ON of a not-shown switch, a process of starting the dry cleaning operation is executed in a first step S1.

In the step S1 as the process of starting the dry cleaning operation, the drum motor 7 is controlled so as to rotate the inner drum 1*a* of the process tank 1 at the smallest rotating speed within an allowable range according to a material of the cleaning objects A by means of the inverter 25.

In the step S1 of the process of starting, amount of the pure solvent supplied from the supply tank 3 to the process tank 1 and sprayed from the nozzle 1*b* into the inner drum 1*a* of the process tank 1 is made to be suitable amount corresponding to the material of the cleaning objects A by controlling the supply-side pump 9. And, amount of the used solvent collected from the process tank 1 to the distilling unit 5 is made to be suitable amount corresponding to the amount of the pure solvent sprayed in the inner drum 1*a* by controlling the collect-side pump 11.

In the step S1 of the process of starting, a not-shown heater of the distilling unit 5 is turned ON.

Following the step S1 of the process of starting the dry cleaning operation, the control unit 19 receives the digital values of chromaticities of RGB colors of the pure solvent from the supply tank 3, the chromaticities detected by the supply-side RGB color sensor 15, from the supply-side sensing unit 17, and the digital values of chromaticities of RGB colors of the used solvent collected from the process tank 1, the chromaticities detected by the collect-side RGB color sensor 21, from the collect-side sensing unit 23 (step S3).

After that, difference values about each color are calculated by subtracting respectively the digital values of chromaticities of RGB colors of the used solvent, received from the collect-side sensing unit 23 just after the step S1 of the process of starting in the step S3, from the digital values of chromaticities of RGB colors of the used solvent, received from the collect-side sensing unit 23 in the step S3 (step S5).

After that, it is judged whether or not the chromaticities of the color component other than that of the specific color of the oil stained component (mainly yellow) in the used solvent collected from the process tank 1 at the present time become over predetermined reference values against the chromaticities of those at the time just after the step S1 of the process of starting, based on the difference values of respective colors calculated in the step S5 (step S7). If the chromaticities become over the values (Y in the step S7), the process will be moved to a later-described step S17.

If the chromaticities do not become over the values (N in the step S7), the other difference values about each color are calculated by subtracting respectively the digital values of chromaticities of RGB colors of the pure solvent, received from the supply-side sensing unit 17 in the step S3, from the digital values of chromaticities of RGB colors of the used solvent, received from the collect-side sensing unit 23 in the step S3 (step S9).

After that, it is judged whether or not the chromaticity of the specific color of the oil stained component (mainly yellow) in the used solvent collected from the process tank 1 is higher than the chromaticity of the specific color of the oil stained component (mainly yellow) in the pure solvent supplied from the supply tank 3 to the process tank 1; based on the difference values of respective colors calculated in the step S9 (step S11) If the chromaticity is not higher (N in the step S11), the process will be moved to the step S17.

If the chromaticity of the specific color of the oil stained component (mainly yellow) in the used solvent is higher than that of the specific color of the oil stained component (mainly yellow) in the pure solvent (Y in the step S11), it is judged whether or not a difference between chromaticities of the specific color of the oil stained component in the used and pure solvents is under a predetermined threshold value (step S13). If the difference is not under the threshold value (N in the step 13), the process returns to the step S3.

Oppositely, if the difference is under the threshold value (Y in the step 13), the drum motor 7 is controlled through the inverter 25 so as to rotate the inner drum 1*a* of the process tank 1 within allowable range of rotating speed corresponding to the cleaning objects A. Thereafter, the process returns to the step S3.

In the case of Y in the step S7, when the chromaticities of the color components other than that of the specific color of the oil stained component (mainly yellow) in the used solvent collected from the process tank 1 at the present time become over predetermined reference values against the chromaticities of those at the time just after the step S1 of the process of starting, and in the case of N in the step S11, when the chromaticity of the specific color of the oil stained component (mainly yellow) in the used solvent collected from the process tank 1 is not higher than the chromaticity of the specific color of the oil stained component (mainly yellow) in the pure solvent supplied from the supply tank 3 to the process tank 1, the process moves to the step S17 of ending the process of the dry cleaning operation.

In ending the process of the dry cleaning operation in the step S17, the supply-side pump 9 and the collect-side pump 11 are controlled so as to make the amount of the pure solvent supplied from the supply tank 3 to the process tank 1 and sprayed from the nozzles 1*b*, 1*c* into the inner drum 1*a* of the process tank 1 and the amount of the used solvent collected from the process tank 1 to the distilling unit 5 zero.

In starting the process of the dry cleaning operation in the step S1, the drum motor 7 is controlled through the inverter 25 so as to stop rotation of the inner drum 1*a* of the process tank 1, and a not-shown heater of the distilling unit 5 is tuned OFF.

After ending the process of the dry cleaning operation is completed, the series of the process is ceased.

In the dry cleaning apparatus according to the embodiment as structured above, the drum motor 7 rotates the inner drum 1*a* of the process tank 1 at the minimum rotating speed within an allowable range corresponding to the materials of the cleaning objects A in starting the process. The cleaning objects A inputted in the inner drum 1*a* are dry-cleaned with the pure solvent supplied continuously from the supply tank 3 by the supply-side pump 9 and sprayed from the nozzle 1*b* into the inner drum 1*a* of the process tank 1.

Simultaneously, the used solvent after sprayed into the inner drum 1*a* and used for dry-cleaning the cleaning objects A is collected continuously by the collect-side pump 11 from the process tank 1 to the distilling unit 5, and reproduced to pure solvent and returned to the supply tank 3. Thus, all amount of the used solvent is recycled to the pure solvent to be supplied from the supply tank 3 to process tank 1.

In early process of dry-cleaning the cleaning objects A inputted into the process tank 1, an amount of the oil stained component dissolved from the cleaning objects A into the pure solvent sprayed in the inner drum 1*a* is relatively large. Thereby, the chromaticity of the specific color of the oil stained component (mainly yellow) in the used solvent collected continuously by the collect-side pump 11 from the process tank 1 to the distilling unit 5, detected by the collect-side RGB color sensor 21, i.e. the contamination level of the used solvent, is higher than the chromaticity of the specific color of the oil stained component (mainly yellow) in the pure solvent supplied continuously by the supply-side pump 9 from the supply tank 3 to the process tank 3, detected by the supply-side RGB color sensor 15, i.e. the contamination level of the pure solvent.

By proceeding the process of the dry cleaning operation, dirt remained in the cleaning objects A is generally decreased, and the amount of the oil stained component dissolved from the cleaning objects A into the pure solvent sprayed in the inner drum 1*a* is reduced. Then, the contamination level of the used solvent detected by the collect-side RGB sensor 21 is decreased to approach to the contamination level of the pure solvent detected by the supply-side RGB sensor 15. Thus, in the dry cleaning operation in the process tank 1, washing process is actually shifted to rinsing process.

During the process, according to reduction of the amount of the oil stained component dissolved from the cleaning objects A into the pure solvent sprayed in the inner drum 1*a*, the contamination level of the used solvent detected by the collect-side RGB sensor 21 is decreased. Thereby, when the difference between the contamination level and that of the pure solvent detected by the supply-side RGB sensor 15 becomes under the predetermined threshold value, rotating speed of the inner drum 1*a* of the process tank 1 driven by the drum motor 7 is changed from the minimum rotating speed within the allowable range corresponding to the materials of the cleaning objects A to higher rotating speed than the minimum rotating speed.

In the minimum rotating speed, the cleaning objects A are not pushed much on the inner wall of the inner drum 1*a* to roll relatively frequently in the inner drum 1*a* so that cleaning process can be progressed by effects of tapping the cleaning objects A on the inner wall of the inner drum 1*a*. By changing higher rotating speed, the centrifugal force acting on the cleaning objects A in the inner drum 1*a* is increased so that the cleaning objects are pushed on the inner wall of the inner drum 1*a* and the effects of tapping the objects on the inner wall is decreased. Therefore, unexpected over-cleaning the cleaning objects is limited and cloths of the cleaning objects and touch thereof are protected.

Dirt of the cleaning objects A is washed in a certain level and the washing process in the dry cleaning operation is shifted to the rinsing process. The amount of the oil stained component dissolved from the cleaning objects A into the pure solvent sprayed in the inner drum 1*a* is decreased to a certain value. Thereby, the contamination level of the used solvent detected by the collect-side RGB sensor 21 is reduced to become the same as the contamination level of the pure solvent detected by the supply-side RGB sensor 15. Because, in the embodiment, the predetermined value is zero, so that it corresponds to "decreases under a predetermined value" in the specification.

Thereby, the control unit 19 stops rotation of the inner drum 1*a* by the drum motor 7, supply of the pure solvent from the supply tank 3 to the process tank 1 by the supply-side pump 11, and collection of the used solvent from the process tank 1 to the distilling unit 5 by the collect-side pump 11. Thus, cleaning operation of the cleaning objects A in the process tank 1 is ceased.

In the dry cleaning apparatus according to the embodiment, when the cleaning objects A are discolored in the dry cleaning operation, and the color elements are dissolved in the pure solvent in the inner drum 1*a* so that the chromaticities of the color components other than that of the specific color of the oil stained component (mainly yellow) in the used solvent increase over reference values, even if the contamination level of the used solvent detected by the collect-side RGB sensor 21 does not become the same as that of the pure solvent detected by the supply-side RGB sensor 15, the control unit 19 stops rotation of the inner drum 1*a* by the drum motor 7, supply of the pure solvent from the supply tank 3 to the process tank 1 by the supply-side pump 11, and collection of the used solvent from the process tank 1 to the distilling unit 5 by the collect-side pump 11 for preventing further discoloration of the cleaning objects. Thus, dry cleaning operation of the cleaning objects A in the process tank 1 is ceased.

According to the dry cleaning apparatus of the embodiment, the contamination level of the pure solvent supplied from the supply tank 3 to the inner drum 1*a* of the process tank 1 by the supply-side pump 9 is detected by the supply-side RGB sensor 15, and the contamination level of the used solvent collected from the process tank 1 to the distilling unit 5 by the collect-side pump 11 is detected by the collect-side RGB sensor 21, and when the difference value between the contamination levels becomes zero, the control unit 19 stops rotation of the inner drum 1*a* by the drum motor 7, supply of the pure solvent from the supply tank 3 to the process tank 1 by the supply-side pump 11, and collection of the used solvent from the process tank 1 to the distilling unit 5 by the collect-side pump 11 for preventing further discoloration of the cleaning objects. Thus, dry cleaning operation of the cleaning objects A in the process tank 1 is ceased.

Instead of determining the stop timing of dry cleaning operation by time as usual, determining the suitable stop timing by detecting the completion level of washing of the cleaning objects A securely with the control unit 19 by comparing contamination level of the used solvent detected by the collect-side RGB sensor 21 with the contamination level of the pure solvent supplied to the inner drum 1*a*, energy loss by unexpected distillation-and-condensation process of the solvent and unexpected deterioration of cloths of cleaning objects A caused by contacting with the solvent in the inner drum 1*a* for long time over required time can be prevented.

The contamination levels of the pure solvent supplied to the inner drum 1*a* and the used solvent may be detected as turbidity, instead of the chromaticity of the specific color of the oil stained component in this embodiment. The turbidity can be detected by a photo-interrupter (a light emitting-receiving element) simpler than the supply-side sensor 15 and the collect-side RGB sensor 21.

Against detecting an indicator other than the chromaticity of the specific color of the oil stained component (mainly yellow) for monitoring the contamination level of the solvent, by detecting the chromaticity of the specific color of the oil stained component in this embodiment, control unit 19 can detect the contamination level of the solvent more securely, and determine the suitable stop timing of dry cleaning operation of the cleaning objects A in the process tank 1. Thereby, energy loss by unexpected distillation-and-condensation process of the solvent and unexpected deterioration of cloths of cleaning objects A caused by contacting with the solvent in the inner drum 1*a* for long time over required time can be prevented more.

The structure required in this embodiment for ceasing dry cleaning operation of the cleaning objects A in the process tank 1 when the chromaticities of the color components other than that of the specific color of the oil stained component in the used solvent detected by the collect-side RGB sensor 21 become over the reference values determined after starting dry cleaning operation may be eliminated.

If the above structure of this embodiment is applied to the dry cleaning apparatus, by preventing that the increase of contamination level of the used solvent by the discoloration of the cleaning objects A, which is detected by the collect-side RGB sensor 21, is identified by the control unit 19 as a condition that dirt of cleaning objects A is not completely removed, cloths of the cleaning objects A that is dyed not strongly is prevented from discoloring.

The structure required in this embodiment for changing the rotating speed of the inner drum 1*a* of the process tank 1 driven by the drum motor 7 from the minimum rotating speed within the allowable range corresponding to the materials of the cleaning objects A to higher rotating speed than the minimum rotating speed with the control unit 19 when the difference value between the contamination level of the used solvent detected by the collect-side RGB sensor 21 and that of the pure solvent detected by the supply-side RGB sensor 15 becomes under the predetermined threshold value may be eliminated.

If the above structure of this embodiment is applied to the dry cleaning apparatus, when the dirt from the cloths is dissolved relatively much in the solvent in the inner drum 1*a* of the process tank 1, the rotating speed of the inner drum 1*a* is reduced so as to roll the cleaning objects A relatively frequently in the inner drum 1*a* for progressing cleaning process by effects of tapping the cleaning objects A. When the dirt from the cloths is not dissolved relatively so much in the solvent in the inner drum 1*a*, the rotating speed of the inner drum 1*a* is increased so as to increase the centrifugal force acting on the cleaning objects A, and push the cleaning objects A on the inner wall of the inner drum 1*a* for decreasing the effects of tapping the objects on the inner wall of the inner drum 1*a*. Thereby, controlling the suitable stop timing of dry cleaning operation can be determined both for protecting cloths and touch of the cleaning objects and for progressing cleaning operation.

In the dry cleaning apparatus according to this embodiment, when the contamination level of the used solvent detected by the collect-side RGB sensor 21 becomes the same as that of the pure solvent detected by the supply-side RGB sensor 15, the dry cleaning operation of the cleaning objects A in the process tank 1 is ceased. The dry cleaning operation of the cleaning objects A in the process tank 1 can be ceased when the difference value between the contamination level of the used solvent detected by the collect-side RGB sensor 21 and that of the pure solvent detected by the supply-side RGB sensor 15 becomes within the predetermined value (not zero).

The dry cleaning method, which uses only solvent with the dry cleaning apparatus according to this embodiment, is to wash water-soluble dirt of the cleaning objects A only with moisture in the air, and to return all of the used solvent, which is collected from the inner drum 1*a* of the process tank 1 and reproduced by the distilling unit 5, to the supply tank 3, and to supply the pure solvent continuously without any filters to the inner drum 1*a* for replenishing the inner drum 1*a*. Thereby, washing and rinsing can be operated continuously. When the cleaning objects A holds enough pure solvent, even if liquid level of the solvent in the inner drum 1*a* is made almost zero, cleaning is performed enough.

Thus, the dry cleaning apparatus according to this embodiment can perform enough cleaning with such small amount of the solvent, and also reduce total amount of the solvent by reproducing all of the used solvent in the distilling unit 5 and supplying as the pure solvent continuously to the inner drum 1*a*. Therefore, the dry cleaning apparatus can improve environment issues.

A general dry cleaning apparatus is designed to wash objects with a solvent including detergent at liquid level of 4/10 radius of the inner drum 1*a* and to rinse the objects with the solvent including detergent at liquid level of 8/10 radius of the inner drum 1*a*. Therefore, the general dry cleaning cannot perform the dry cleaning operation at liquid level of almost zero.

For changing amount of the solvent in the inner drum 1*a* to any values during dry cleaning operation, the dry cleaning apparatus according to this embodiment can be further provided with a setting device (not shown) such as a dial knob, a ten key, and push button for setting a determined value.

Thereby, the control unit 19 may control amount of the pure solvent supplied from the supply tank 3 to the process tank 1 by the supply-side pump 9 and amount of the used solvent collected from the process tank 1 to the distilling unit 5 by the collect-side pump 11 with the inverters 27, 29.

It is further understood by those skilled in the art that the foregoing description is a preferred embodiment of the disclosed device and that various changes and modifications may be made in the invention without departing from the spirit and scope thereof.

What is claimed is:

1. A dry cleaning method, which includes the steps of supplying a solvent for dry cleaning without a surface-active agent into a process tank for cleaning objects, collecting the solvent from the process tank as a collected solvent, and recycling substantially whole volume of the collected solvent as the solvent to be supplied to the process tank after removing dirt component in the collected solvent by distillation-and-condensation process, the dry cleaning method further comprises the steps of:

storing the solvent to be supplied to the process tank in a supply tank;

collecting the solvent continuously from the process tank;

supplying the collected solvent to the distillation-and-condensation process;

replenishing the solvent in the process tank by supplying continuously the solvent from the supply tank to the process tank;

monitoring contamination level of the solvent being supplied continuously from the supply tank to the process tank and that of the collected solvent being collected continuously from the process tank and supplied to the distillation-and-condensation process; and ceasing process of dry cleaning operation for the cleaning objects in the process tank when the contamination level of the collected solvent being collected from the process tank and supplied to the distillation-and-condensation process is decreased until a difference of the monitored contamination levels reaches to a predetermined value after starting dry cleaning operation for the cleaning objects.

2. The dry cleaning method according to claim 1, wherein a color sensor capable of detecting a chromaticity of a specific color component in the solvent is used for monitoring the contamination level so as to monitor the chromaticity of a specific color of an oil stained component in the solvent.

3. A dry cleaning method which includes the steps of supplying a solvent for dry cleaning without a surface-active anent into a process tank for cleaning objects, collecting the solvent from the process tank as a collected solvent, and recycling substantially whole volume of the collected solvent as the solvent to be supplied to the process tank after removing dirt component in the collected solvent by distillation-and-condensation process, the dry cleaning method further comprises the steps of:

storing the solvent to be supplied to the process tank in a supply tank;

collecting the solvent continuously from the process tank;

supplying the collected solvent to the distillation-and-condensation process;

replenishing the solvent in the process tank by supplying continuously the solvent from the supply tank to the process tank;

monitoring contamination level of the solvent being supplied continuously from the supply tank to the process tank and that of the collected solvent being collected continuously from the process tank and supplied to the distillation-and-condensation process;

decreasing a rotation speed of the process tank, when the difference of the monitored contamination levels is increases, and increasing the rotational speed of the process tank when the rotation speed of the process tank is decreased, and when the difference of the contamination levels decreases, the rotation speed of the process tank decreases; and ceasing process of dry cleaning operation for the cleaning objects in the process tank when the contamination level of the collected solvent being collected from the process tank and supplied to the distillation-and-condensation process is decreased until a difference of the monitored contamination levels reaches to a predetermined value after starting dry cleaning operation for the cleaning objects.

4. The dry cleaning method according to claim 3, wherein a color sensor capable of detecting a chromaticity of a specific color component in the solvent is used for monitoring the contamination level so as to monitor the chromaticity of a specific color of an oil stained component in the solvent.

5. A dry cleaning method which includes the steps of supplying a solvent for dry cleaning without a surface-active agent into a process tank for cleaning objects, collecting the solvent from the process tank as a collected solvent, and recycling substantially whole volume of the collected solvent as the solvent to be supplied to the process tank after removing dirt component in the collected solvent by distillation-and-condensation process, the dry cleaning method further comprises the steps of:

storing the solvent to be supplied to the process tank in a supply tank;

collecting the solvent continuously from the process tank;

supplying the collected solvent to the distillation-and-condensation process:

replenishing the solvent in the process tank by supplying continuously the solvent from the supply tank to the process tank;

monitoring contamination level of the solvent being supplied continuously from the supply tank to the process tank and that of the collected solvent being collected continuously from the process tank and supplied to the distillation-and-condensation process by using a color sensor capable of detecting a chromaticity of a specific color component in the solvent; and ceasing process of dry cleaning operation for the cleaning objects in the process tank when the contamination level of the collected solvent being collected from the process tank and supplied to the distillation-and-condensation process is decreased until a difference of the monitored contamination levels reaches to a predetermined value after starting dry cleaning operation for the cleaning objects or when the chromaticity of a color component other than that of a specific color of an oil stained component in the collected solvent, which is collected from the process tank and being supplied to the distillation-and-condensation process, detected by the color sensor increases over a reference value after starting dry cleaning operation for the cleaning objects whether or not the contamination level of the collected solvent being collected from the process tank and supplied to the distillation-and-condensation process is decreased until the difference of the monitored contamination levels reaches to the predetermined value.

6. A dry cleaning method which includes the steps of supplying a solvent for dry cleaning without a surface-active agent into a process tank for cleaning objects. collecting the solvent from the process tank as a collected solvent, and recycling substantially whole volume of the collected solvent as the solvent to be supplied to the process tank after removing dirt component in the collected solvent by distillation-and-condensation process, the dry cleaning method further comprises the steps of:

storing the solvent to be supplied to the process tank in a supply tank;

collecting the solvent continuously from the process tank;

supplying the collected solvent to the distillation-and-condensation process;

replenishing the solvent in the process tank by supplying continuously the solvent from the supply tank to the process tank;

monitoring contamination level of the solvent being supplied continuously from the supply tank to the process tank and that of the collected solvent being collected continuously from the process tank and supplied to the distillation-and-condensation process; and ceasing process of dry cleaning operation for the cleaning objects in the process tank when the contamination level of the collected solvent being collected from the process tank and supplied to the distillation-and-condensation process is decreased until a difference of the monitored contamination levels reaches to a predetermined value after starting dry cleaning operation for the cleaning objects or when the chromaticity of a color component other than that of the specific color of the oil stained component is the solvent, which is collected from the process tank and supplied to the distillation-and-condensation process, detected by the color sensor increases over a reference value after starting dry cleaning operation for the cleaning objects whether or not the contamination level of the solvent being collected from the process tank and supplied to the distillation-and-condensation process is decreased until the difference of the monitored contamination levels reaches to the predetermined value.

7. A dry cleaning method which includes the steps of:

supplying a solvent for dry cleaning into a process tank for cleaning objects, collecting the solvent from the process tank as a collected solvent, and recycling substantially whole volume of the collected solvent as the solvent to be supplied to the process tank after removing dirt component in the collected solvent by distillation-and-condensation process, the dry cleaning method further comprises the steps of:

storing the solvent to be supplied to the process tank in a supply tank;

collecting the solvent continuously from the process tank;

supplying the collected solvent to the distillation-and-condensation process;

replenishing the solvent in the process tank by supplying continuously the solvent from the supply tank to the process tank;

monitoring contamination level of the solvent being supplied continuously from the supply tank to the process tank and that of the collected solvent being collected continuously from the process tank and supplied to the distillation-and-condensation process; and ceasing process of dry cleaning operation for the cleaning objects in the process tank when the contamination level of the collected solvent being collected from the process tank and supplied to the distillation-and-condensation process is decreased until a difference of the monitored contamination levels reaches to a predetermined value after starting dry cleaning operation for the cleaning objects, wherein when the difference of the monitored contamination levels increases, the rotation speed of the process tank is decreased, and when the difference of the contamination levels decreases, the rotation speed of the process tank increases, wherein a color sensor capable of detecting a chromaticity of a specific color component in the solvent is used for monitoring the contamination level of the collected solvent being collected from the process tank and being supplied to the distillation-and-condensation process, wherein the process of the dry cleaning operation for the cleaning objects in the process tank is ceased forcibly when the chromaticity of a color component other than that of a specific color of an oil stained component in the collected solvent, which is collected from the process tank and being supplied to the distillation-and-condensation process, detected by the color sensor increases over a reference value after starting dry cleaning operation for the cleaning objects whether or not the contamination level of the collected solvent being collected from the process tank and supplied to the distillation-and-condensation process is decreased until the difference of the monitored contamination levels reaches to the predetermined value.

8. A dry cleaning method which includes the steps of:

supplying a solvent for dry cleaning into a process tank for cleaning objects, collecting the solvent from the process tank as a collected solvent, and recycling substantially whole volume of the collected solvent as the solvent to be supplied to the process tank after removing dirt component in the collected solvent by distillation-and-condensation process, the dry cleaning method further comprises the steps of:

storing the solvent to be supplied to the process tank in a supply tank;

collecting the solvent continuously from the process tank;

supplying the collected solvent to the distillation-and-condensation process;

replenishing the solvent in the process tank by supplying continuously the solvent from the supply tank to the process tank;

monitoring contamination level of the solvent being supplied continuously from the supply tank to the process tank and that of the collected solvent being collected continuously from the process tank and supplied to the distillation-and-condensation process; and ceasing process of dry cleaning operation for the cleaning objects in the process tank when the contamination level of the collected solvent being collected from the process tank and supplied to the distillation-and-condensation process is decreased until a difference of the monitored contamination levels reaches to a predetermined value after starting dry cleaning operation for the cleaning objects, wherein when the difference of the monitored contamination levels increases, the rotation speed of the process tank is decreased, and when the difference of the contamination levels decreases, the rotation speed of the process tank increases, wherein a color sensor capable of detecting a chromaticity of a specific color component in the solvent is used for monitoring the contamination level so as to monitor the chromaticity of a specific color of an oil stained component in the solvent, wherein the color sensor capable of detecting the chromaticity of the specific color component in the solvent is used for monitoring the contamination level of the collected solvent being collected from the process tank and supplied to the distillation-and-condensation process, wherein the dry cleaning operation for the cleaning objects in the process tank is ceased forcibly when the chromaticity of a color component other than that of the specific color of the oil stained component in the solvent, which is collected from the process tank and supplied to the distillation-and-condensation process, detected by the color sensor increases over a reference value after starting dry cleaning operation for the cleaning objects whether or not the contamination level of the solvent being collected from the process tank and supplied to the distillation-and-condensation process is decreased until the difference of the monitored contamination levels reaches to the predetermined value.

* * * * *